United States Patent [19]

Kurihara et al.

[11] 4,386,861

[45] Jun. 7, 1983

[54] DOT MATRIX IMPACT PRINTER

[75] Inventors: Toshio Kurihara; Masao Kunita; Makoto Yasunaga; Satoru Uchida, all of Tokorozawa, Japan

[73] Assignee: Citizen Watch Co., Ltd., Tokyo, Japan

[21] Appl. No.: 274,742

[22] Filed: Jun. 18, 1981

[30] Foreign Application Priority Data

Jun. 26, 1980 [JP] Japan ..... 55-86777
Jun. 26, 1980 [JP] Japan ..... 55-86778

[51] Int. Cl.[3] ..... B41J 3/12; B41J 27/02

[52] U.S. Cl. ..... 400/124; 400/470; 400/554

[58] Field of Search ..... 400/124, 240.2, 240.3, 400/470, 471, 471.1, 554

[56] References Cited

U.S. PATENT DOCUMENTS 698,151 4/1902 Stickney ..... 400/554
4,210,917 7/1980 Lane ..... 400/470 X

FOREIGN PATENT DOCUMENTS 55-51576 4/1980 Japan ..... 400/471

OTHER PUBLICATIONS

*IBM Tech. Disc. Bulletin,* by J. M. Dunn, vol. 22, No. 10, Mar. 1980, pp. 4364–4365.

*Primary Examiner*—Paul T. Sewell
*Attorney, Agent, or Firm*—Birch, Stewart, Kolasch and Birch

[57] ABSTRACT

A dot matrix impact printer for color printing comprising a platen and a print wire. The platen comprises a plurality of members made of porous material containing different colors. The print wire and platen member are driven to a position adjacent each other and the print wire is moved to force a paper to the platen, so that a dot is printed on the paper with color ink contained in the corresponding member of the platen.

4 Claims, 5 Drawing Figures

DOT MATRIX IMPACT PRINTER

BACKGROUND OF THE INVENTION

The present invention relates to a dot matrix impact printer of the type in which the print wire travels along the surface of the paper during the impact printing, and more particularly to a dot matrix impact printer for colour printing.

A conventional colour printer comprises a ribbon having a plurality of colour ink absorbing portions which are arranged longitudinally and side by side. The ribbon is moved so as to position a required colour ink absorbing portion to the printing position and forced against the paper by the print wire for a colour printing, while the paper is advanced. After completion of printing with the colour ink, the ribbon is further moved forwards or rearwards for another colour printing, while the paper is backed to the print start position for the colour printing. To accomplish such an operation, there is provided in the printer a sensing means for detecting the position of the ribbon and with a special device for driving the ribbon in accordance with the colour to be used. Therefore, the machine is complex in operation and construction. Further, since the ribbon must be moved to a required position and the paper must be backed to a print start position, it takes a long time to print dots, which means a decrease of the operational efficiency.

SUMMARY OF THE INVENTION

The object of the present invention is to provide a dot matrix colour printer which is simplified in construction and has a high operational efficiency.

To this end, according to the present invention, there is provided a dot matrix impact printer comprising a platen comprising a plurality of members made of porous material each of which absorbs colour ink different from the ink of an adjacent member, a print wire carrier slidable along the axial line of said platen, a print wire provided on said print wire carrier, a print wire driving unit provided on said print wire carrier for moving said print wire to said platen, means for shifting said print wire carrier along the axial line of said platen, means for driving said platen to locate one of said members to a position opposite to the end of said print wire, and means for feeding a printing medium in the direction perpendicular to the moving direction of said print wire.

DESCRIPTION OF THE PREFERRED EMBODIMENTS

Figure 1:
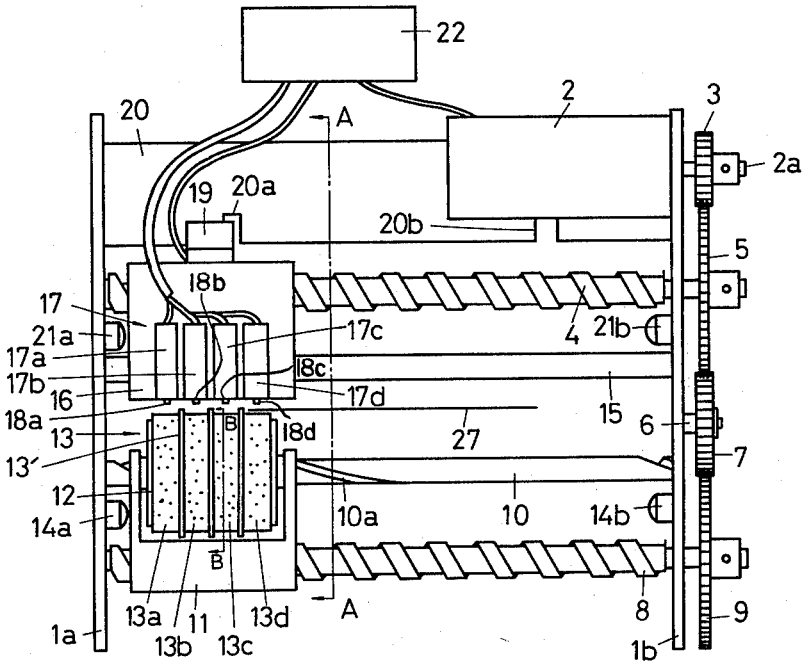
FIG. 1 is a plan view showing a dot matrix impact printer according to the present invention.
Figure 2:
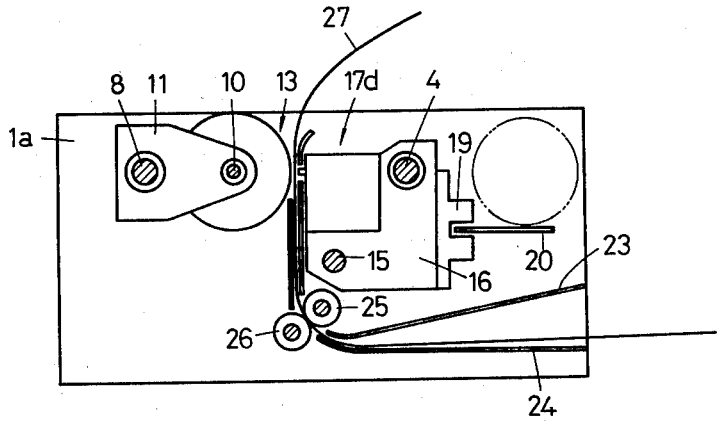
FIG. 2 is a sectional view taken along the line A—A of FIG. 1.
Figure 3:
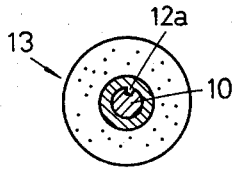
FIG. 3 is a sectional view taken along the line B—B of FIG. 1.

Referring to FIGS. 1 to 3, a machine frame comprises opposite plates 1*a* and 1*b*. A step motor 2 supported on the frame plate 1*b* has a shaft 2*a* which is connected to a print wire unit shifting screw shaft 4 through gears 3 and 5. The screw shaft 4 is rotatably journaled in frame plates 1*a* and 1*b*. The gear 5 of the screw shaft 4 is connected to a gear 9 of a platen shifting screw shaft 8 through an intermediate gear 7 which is rotatably mounted on a pin 6 secured to the frame plate 1*b*. The platen shifting screw shaft 8 is rotatably supported by the frame plates 1*a* and 1*b*. A platen guiding shaft 10 having a helical groove 10*a* is secured to the frame plates 1*a* and 1*b*. A platen carrier 11 is slidably mounted on the platen shifting screw shaft 8 and guiding shaft 10. The platen carrier 11 has an inside projection (not shown) which engages with the screw thread of the screw shaft 8. Thus, rotation of the screw shaft 8 causes the platen carrier 11 to shift along shafts 8 and 10. A platen 13 is secured to a cylindrical platen shaft 12 which is rotatably supported in the platen carrier 11 and slidably engaged with the platen guiding shaft 10. The platen shaft 12 has an inside projection 12*a* which is engaged with the helical groove 10*a* as shown in FIG. 3, so that the platen shaft 12 is rotated when the carrier 11 moves along the shaft 10.

The platen 13 comprises a plurality of disk members 13*a* to 13*d* and separating members 13', which are integrated with each other. Each disk member is made of porous member such as porous body of nylon. The first disk member 13*a* is impregnated with black ink, the second disk member 13*b* is impregnated with red ink, the third disk member 13*c* with blue ink and the fourth disk member 13*d* with yellow ink. The periphery of each separating member 13' projects from the periphery of disk members 13*a* to 13*d* so that a paper 27 as a printing medium may not be stained with ink. A pair of platen carrier stoppers 14*a* and 14*b* made of resilient material such as rubber are secured to frame plates 1*a* and 1*b*, respectively.

A print wire carrier guiding shaft 15 is secured to frame plates 1*a* and 1*b*. Slidably mounted on screw shaft 4 and guiding shaft 15 is a print wire carrier 16 which has an inside projection (not shown) engaging with the helical groove of the screw shaft 4. Thus, the print wire carrier 16 is moved along the screw shaft 4 and guiding shaft 15 by rotating the screw shaft 4. The print wire carrier 16 is provided with a print wire driving unit 17 comprising a first to fourth print wire driving units 17*a* to 17*d*. The print wire driving units 17*a* to 17*d* have print wires 18*a* to 18*d* respectively, which are adjacent to corresponding disk members 13*a* to 13*d*. A sensor 19 comprising a light emitting element and a light receiving element (not shown) is provided on the carrier 16. The light emitting element and light receiving element are disposed to interpose an indicating plate 20 secured to frame plates 1*a* and 1*b* for detecting the position of printing wires by sensing the light through slits 20*a* and 20*b* formed in the indicating plate 20. Print wire carrier stoppers 21*a* and 21*b* made of rubber are secured to frame plates 1*a* and 1*b*.

A driving control circuit 22 comprises a dot line memory, dot pulse generator, dot counter, colour signal generating circuit, collating circuit, timing signal generating circuit, print wire driving circuit, stepping motor driving circuit and sequence control circuit.

As shown in FIG. 2, a first guide plate 23 and a second guide plate 24 are provided for guiding a paper 27. The first guide plate 23 has apertures for print wires and a feed roller 25, and the second guide plate 24 has an aperture for a feed roller 26. Feed rollers 25 and 26 are made of friction material and are pivotally supported by frame plates 1*a* and 1*b*. The feed roller 25 is driven by a driving device (not shown).

In operation, when a printout is applied to the driving control circuit 22, the control circuit produces outputs to drive the stepping motor 2 for rotating the shaft 2*a* in a predetermined acceleration mode. The rotation of the shaft 2*a* is transmitted to screw shafts 4 and 8 through gears 3, 5, 7, and 9, so that the platen carrier 11 and the print wire carrier 16 travel to the right in FIG. 1. During the movement of the print wire carrier 16, the sensor 19 senses the light passing through the slit 20*a* and thereafter the light is shielded by the trailing edge of the slit. By such a detecting mode, the fact that the print wire carrier has been started and is in the constant speed moving zone is detected. At that time, the dot counter of the driving control circuit 22 starts to count pulses for driving the stepping motor 2. In the memory in the driving control circuit 22, data relative to dots of matrix for forming a desired letter or others are stored at every dot line including colour data for the dot. The colour signal generating circuit in the control circuit 22 is adapted to produce colour signal in accordance with the colour data for designating one of print wire driving units 17*a* to 17*d*.

The output of the dot counter, the dot data stored in the memory and the colour signal are collated in the collating circuit. When those signals match, the collating circuit produces a driving signal for driving the corresponding print wire driving unit. Thus, the print wire forces the paper 27 to the corresponding disk member of the platen 13, so that the dot is printed with the colour ink impregnated in the disk member.

The platen carrier 11 travels together with the print wire carrier 16 while keeping the mutual position and the platen 13 is slowly rotated by engagement with the helical groove 10*a*. Thus, when the designated print wire reaches a printing position, the print wire is driven to print the dot. Such an operation is performed at every printing position with respect to every print wire driving unit. When the print wire carrier 16 reaches to the slit 20*b* of the right end of the indicating plate 20, the output of the control circuit 22 for driving the stepping motor 2 changes to a predetermined decelerating mode, and when the light is shielded by the trailing edge of the slit, the output disappears and is then inverted. Accordingly, both carriers 16 and 11 are decelerated, stopped and shifted to the left. During the return motion of the carriers, the feed roller 25 is rotated a small angle, so that the paper 27 is upwardly fed one dot line pitch. While carriers are shifted to the left, colour printing of the next dot line is performed in the same manner as in the above described manner. By repeating the above operation a, colour print with the desired colour ink is obtained.

Figure 4:
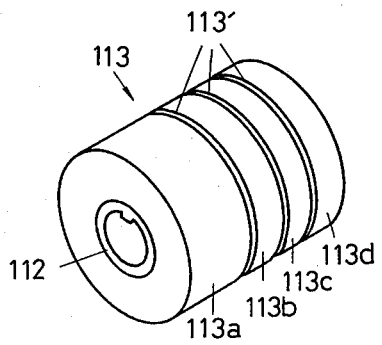
FIG. 4 is a perspective view showing a platen of a second embodiment of the present invention.

FIG. 4 shows another example of the platen assembly. The platen assembly 113 comprises a cylindrical platen shaft 112, a first disk member 113*a* impregnated with black ink, second disk member 113*b* with red ink, third disk member 113*c* with blue ink, fourth disk member 113*d* with yellow ink, and separating members 113'. The first disk member 113*a* has an axial length longer than the other disk members to absorb a large amount of black ink. This is advantageous for the black ink platen, since a large amount of black ink is used compared with the other colour inks.

Generally, since black ink is used more often than other inks in colour printing the, black ink is rapidly consumed. It is uneconomical to replace the entire platen assembly with a new platen assembly just to resupply the black ink. The second embodiment of the present invention reduces such a disadvantage. On the other hand, in an ink supply type platen assembly, it is not efficient to stagger one ink supply period from that of the other inks. In accordance with the second embodiment, it is possible to design the platen assembly such that each disk member has an approximately equal period for the ink supply.

It is evident that each of the other disk members other than that for black ink may be enlarged to have proper ink content.

Figure 5:
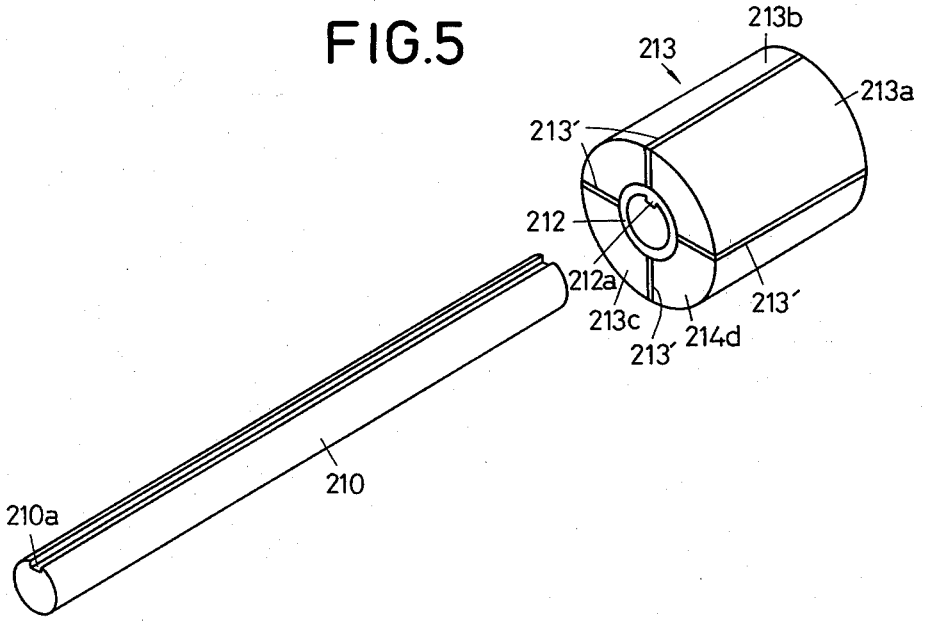
FIG. 5 is an exploded perspective view showing a platen of a third embodiment.

Referring to FIG. 5 showing a third embodiment of the present invention, a platen assembly 213 comprises a cylindrical platen shaft 212, radially separated four segment members 213*a* to 213*d* and separating members 213'. Each segment member is made of porous material similar to the previous embodiment. The first segment member is for black ink and other segment members are respectively for red, blue and yellow. The cylindrical platen shaft 212 is slidably engaged with a platen guiding shaft 210 which is rotatably supported by the frame plates. The platen guiding shaft 210 has an axially extended groove 210*a* with which an inside projection 212*a* of the platen shaft 212 is engaged. The platen 213 is rotated by a stepping motor (not shown) through the platen guiding shaft.

Print wire driving units (not shown) are arranged in the direction perpendicular to the moving direction of the print wire driving unit, that is along the feeding direction of the paper. Further, the print wire carrier and platen carrier are adapted to be intermittently moved by a driving device (not shown).

In this system, printing is carried out at every column along the column of print wires. The platen is continuously rotated. When a segment member of the platen 213 necessary to print a dot with a designated colour reaches to a position corresponding to the dot, the print wire driving unit is actuated to drive the print wire for print of the dot. When all dots designated in the column are printed, the print wire carrier is shifted one pitch. Then, dots in the next column are printed. By repeating such an operation, desired colour printing may be performed.

It will be understood that the axial length of the platen can be equal to the width of the printing range on the paper in order to omit the shifting device for the platen. Further, it is possible to provide a printer with only one print wire. In the system of the third embodiment, since the platen is continuously rotated, there is no need to provide a mechanism for selecting colour, whereby the printer is simplified in construction.

From the foregoing it will be understood that the present invention provides a colour printer which is simplified in construction and improved in operational efficiency.

What is claimed is:

1. A dot matrix impact printer comprising a platen comprising a plurality of disk members disposed side by side in the axial direction of the platen, each of said disk members being made of a porous material, impregnated with a colour ink different from the ink of the adjacent member; a print wire carrier juxtapositioned to and slidably mounted along the axial line of said platen having a plurality of print wires provided on said print wire carrier, each of said print wires being adjacent to a corresponding disk member; a print wire driving unit provided on said print wire carrier for moving said each print wire to said platen; means for shifting said print wire carrier along the axial line of said platen; means for shifting said platen along the axial line thereof to keep the respective adjacent relationship to the corresponding print wire; and means for feeding a printing medium in the direction perpendicular to the moving direction of said print wire.

2. A dot matrix impact printer according to claim 1, further comprising means for continuously rotating said platen as said platen moves a printing width in the axial direction.

3. A dot matrix impact printer according to claim 1 wherein at least one of said disk members of said platen is different from the other members in size.

4. A dot matrix impact printer according to claim 2 said means for rotating said platen comprising a guiding shaft having a helical groove on the periphery thereof, and an inside projection of said platen engaged with said helical groove.

* * * * *